US011205874B2

(12) United States Patent
Menzies et al.

(10) Patent No.: US 11,205,874 B2
(45) Date of Patent: Dec. 21, 2021

(54) IDENTICAL MALE AND FEMALE CONNECTOR

(71) Applicant: LEAR CORPORATION, Southfield, MI (US)

(72) Inventors: David Menzies, Linden, MI (US); Anthony Butcher, Troy, MI (US); Bhupinder Rangi, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/715,535

(22) Filed: Dec. 16, 2019

(65) Prior Publication Data

US 2021/0184399 A1 Jun. 17, 2021

(51) Int. Cl.

| | |
|---|---|
| ***H01R 13/62*** | (2006.01) |
| ***H01R 13/627*** | (2006.01) |
| ***H01R 13/506*** | (2006.01) |
| ***H01R 24/84*** | (2011.01) |

(52) U.S. Cl.
CPC ..... *H01R 13/6272* (2013.01); *H01R 13/506* (2013.01); *H01R 24/84* (2013.01)

(58) Field of Classification Search
CPC ..... H01R 13/28; H01R 24/84
See application file for complete search history.

(56) References Cited

U.S. PATENT DOCUMENTS

| | | | | |
|---|---|---|---|---|
| 4,108,527 | A * | 8/1978 | Douty | H01R 13/627 439/465 |
| 4,405,192 | A * | 9/1983 | Eaby | H01R 13/6273 439/358 |
| 4,711,507 | A | 12/1987 | Noorily | |
| RE32,760 | E * | 10/1988 | Chandler | H01R 13/65912 439/188 |
| 5,259,780 | A | 11/1993 | Morrissey et al. | |
| 6,089,898 | A * | 7/2000 | Lincoln, III | H01R 13/6272 439/357 |
| 6,540,529 | B1 | 4/2003 | Yu | |
| 7,988,481 | B2 | 8/2011 | Bethurum et al. | |

* cited by examiner

*Primary Examiner* — Ross N Gushi
(74) *Attorney, Agent, or Firm* — MacMillan, Sobanski & Todd, LLC

(57) ABSTRACT

A connector pair, which is selectively separable, includes a first connector configured to secure first terminals of a first connector wire therein and a second connector, identical to the first connector, configured to secure second terminals of a second connector wire therein. Each of the first and second connectors includes a lower housing including a wire retention channel that receives the respective first or second connector wire therein, terminal retention channels that receive the respective first or second terminals therein, and a latch connector. An upper housing includes securement members that lock to the respective lower housing to retain the respective first or second connector wires and the respective first or second terminals therein. A latch is configured to mate with the latch connector of the opposed connector to retain the first and second connectors together.

9 Claims, 5 Drawing Sheets

IDENTICAL MALE AND FEMALE CONNECTOR

BACKGROUND OF THE INVENTION

The present invention relates to an electrical connector and more particularly to an electrical connector pair that employs identical connectors on the male and female sides.

Electrical connector pairs are typically configured with a male side (half) and a female side (half). The two halves secure to each other to create the connection. For such connector pairs, then, one fabricates the male connector and the separate and differently shaped female connector. This may create more complications and costs than is desired, as both parts are not only fabricated separately, but must be tracked separately and later paired up in equal numbers for each half.

SUMMARY OF THE INVENTION

An embodiment contemplates a connector pair, which is selectively separable, including a first connector configured to secure first terminals of a first connector wire therein and a second connector, identical to the first connector, configured to secure second terminals of a second connector wire therein. Each of the first and second connectors includes a lower housing including a wire retention channel that receives the respective first or second connector wire therein, terminal retention channels that receive the respective first or second terminals therein, and a latch connector; and an upper housing including securement members that snap to the respective lower housing to retain the respective first or second connector wires and the respective first or second terminals therein, and a latch configured to mate with the latch connector of the opposed connector to retain the first and second connectors together.

An embodiment contemplates an electrical connector, which is mountable to an identical second electrical connector, comprising: a lower housing including a wire retention channel configured to receive a connector wire therein, terminal retention channels extending from the wire retention channel and configured to receive terminals extending from the connector wire therein, and a latch connector that is configured to mate with a second latch of the identical second electrical connector to retain the electrical connector to the identical second electrical connector; and an upper housing including securement members that lock to the lower housing to retain the connector wire and the terminals therein, and a latch configured to mate with a second latch connector of the identical second electrical connector to retain the electrical connector to the identical second electrical connector.

An advantage of an embodiment is that the connector is identical for both the male half and female half of the connector pair. This allows for twice the volume production of the same part, which may allow for a lower cost per part, less part numbers to track and no need to assure equal numbers for pairing each male connector to the female connector.

DETAILED DESCRIPTION

Figure 1:
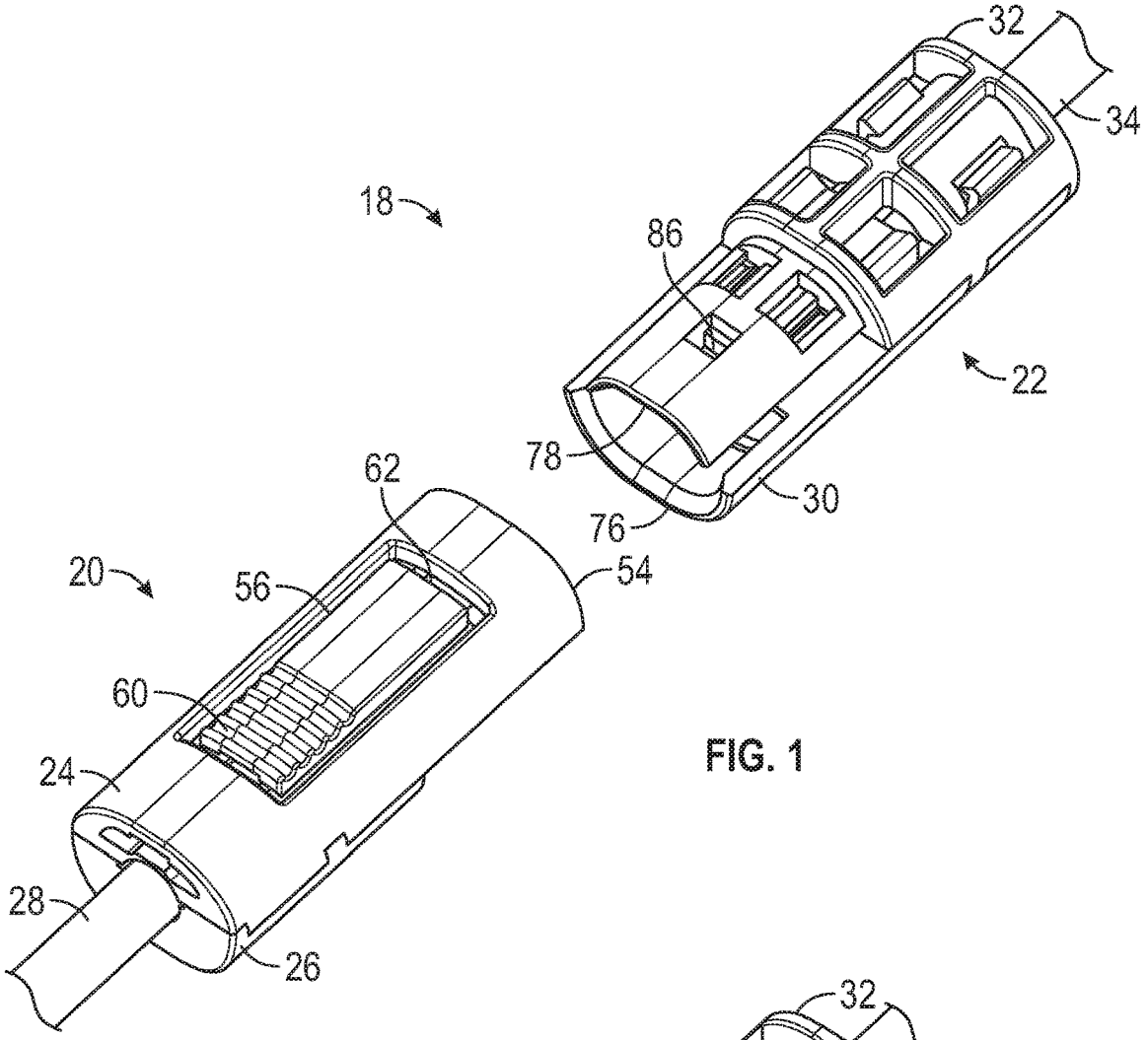
FIG. 1 is a schematic perspective view of a first and second identical mating connectors just prior to mating.

FIGS. 1-9 schematically illustrate a first connector 20 and a second connector 22, which is identical to the first connector 20, forming a connector pair 18. The first connector 20 includes a first upper housing 24, a first lower housing 26 and a first connector wire 28. Since the second connector 22 is identical to the first connector 20, the second connector 22 also includes a second upper housing 30, a second lower housing 32 and a second connector wire 34. The terms "upper" and "lower" are merely for convenience in describing the different components and do not imply any particular orientation in space, other than the orientation of the first connector 20 relative to the second connector 22 for purposes of mating the connectors. The terms "first" and "second" generally relate to elements of the "first" connector 20 and the "second" connector 22, respectively.

While FIGS. 3-6 show just the first connector 20, these figures also represent the same configuration of the second connector 22, since they are identical. As such, the second connector 22 will not be discussed separately relative to FIGS. 3-6. The details of the identical second connector 22, though, are illustrated in FIGS. 1, 2 and 7-9.

The particular elements of the first connector 20 will now be discussed. The first lower housing 26 includes a first main body 38, which includes a first wire retention channel 40, first terminal retention channels 42, a first alignment arm 44, first housing retention locks 46 (which may be, for example, slots), and a first connector latch slot 48 (see in particular FIG. 5). The first wire retention channel 40, which is at a rear of the first lower housing 26, receives the first connector wire 28. The first wire retention channel 40 may have ribs 36 to help secure the first connector wire 28 therein. The first terminal retention channels 42 extend forward from the first wire retention channel 40 and receive a pair of first terminals 50, which extend forward from the first connector wire 28. A pair of first terminal contact beams 52 extend forward from the first terminals 50 into the first alignment arm 44 (see in particular FIGS. 5 and 6). The terms "rear" and "forward" are used merely to signify the relative positions on the particular connector, with "rear" indicating the end of the connector 20 into which the first connector wire 28 extends and "forward" indicating the end of the connector 20 that mates with another connector.

The first housing retention locks 46 may be adjacent to the first wire retention channel 40 and the first terminal retention channels 42. The first main body 38, including the first wire retention channel 40, the first terminal retention channel 42, and the ribs 36, as well as the first alignment arm 44, may all be formed as a single monolithic piece (i.e., integral), such as with a molding process.

The first upper housing 24 is defined by a first shell 54 to which a first latch 56 is pivotably mounted. The first latch 56 includes a short first radial arm 58 extending radially outward from the first shell 54 and a pair of opposed cantilevered latch arms—a first rear cantilevered latch release arm 60 extending from the first radial arm 58 in a direction toward the rear end of the first connector 20 (the end that receives the first connector wire 28), and a first forward cantilevered latch arm 62 extending from the first radial arm 58 in the opposite direction (toward the forward end of the first connector 20 which includes the first alignment arm 44). The first forward cantilevered latch arm 62 includes a first connector latch lock 64 (such as for example a barb) extending radially inward from the free (forward) end of the arm 62.

The first connector latch lock 64 is located and sized to engage in the second connector latch slot 86 on the second lower housing 32 when the first connector 20 is mated with the second connector 22. Additionally, when one presses radially inward on the first rear cantilevered latch release arm 60, this causes the free end of the first forward cantilevered latch arm 62 to pivot radially outward, about the first radial arm 58, lifting the first connector latch lock 64 out of the second connector latch slot 86.

The first upper housing 24 also includes housing retention locks 66 (which may be for example assembly barbs) that extend outward from the first shell 54, on the opposite side of the first shell 54 from the first latch 56. The housing retention locks 66 are located and sized to lock (snap) into the first housing retention locks 46 when the first upper housing 24 is pressed against the first lower housing 26. The first shell 54, first latch 56 and housing retention locks 66 may all be formed as a single monolithic piece (i.e., integral), such as with a molding process.

The assembly of the first connector 20 will now be discussed. The first connector wire 28 is aligned with the first wire retention channel 40 while the first terminals 50 are aligned with the first terminal retention channels 42 of the first lower housing 26. The wire 28 and terminals 50 are inserted into the channel 40 and channels 42, respectively. Then, the first upper housing 24 is moved toward the first lower housing 26, with the housing retention locks 66 aligned with the first housing retention locks 46. The first upper housing 24 is pressed against the first lower housing 26 until the housing retention locks 66 lock (snap) into their respective first housing retention locks 46, at which point the first upper housing 24 is secured to the first lower housing 26 and the first connector wire 28 and the first terminals 50 are held in place. The first connector 20 is now assembled, with the first terminal contact beams 52 extending into and protected by a cavity defined by the first alignment arm 44 and the first shell 54.

The second connector 22, being identical to the first connector 20, has the same elements and configuration and is assembled in the same manner as the first connector 20.

The mating and release of the identical first 20 and second 22 connectors (connector pair 18) will now be discussed. One faces the first 20 and second 22 connectors towards each other (forward ends facing each other), with the first 28 and second 34 connector wires extending out of the rear ends (away from the connection), and with the second connector 22 rotated 180 degrees so that the first lower housing 26 is aligned with the second upper housing 30 (see in particular FIGS. 1, 7 and 8 for this orientation).

The first 20 and second 22 connectors are then moved longitudinally toward each other, with the first alignment arm 44 of the first lower housing 26 telescopically sliding within a second shell 76 of the second upper housing 30 and a second alignment arm 78 of the second lower housing 32 telescopically sliding within the first shell 54 of the first upper housing 24.

As the two connectors 20, 22 continue telescopically sliding toward each other, the first connector latch lock 64 of the first upper housing 24 causes the first forward cantilevered latch arm 62 to pivot outwardly about the first radial arm 58, allowing the first connector latch lock 64 to ride along the outer surface of the second alignment arm 78 of the second lower housing 32; and a second connector latch lock 82 (which may be for example a barb) of the second upper housing 30 causes a second forward cantilevered latch arm 80 to pivot outwardly about a second radial arm 84, allowing the second connector latch lock 82 to ride along the outer surface of the first alignment arm 44 of the first lower housing 26.

Figure 2:
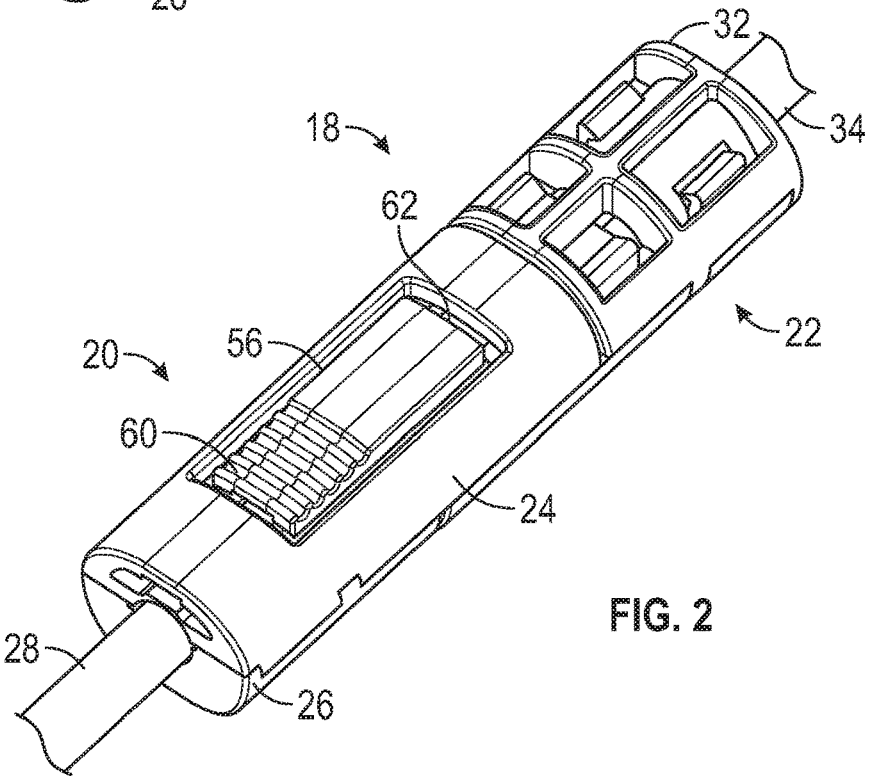
FIG. 2 is a schematic perspective view similar to FIG. 1 but with the first and second connectors mated together.
Figure 3:
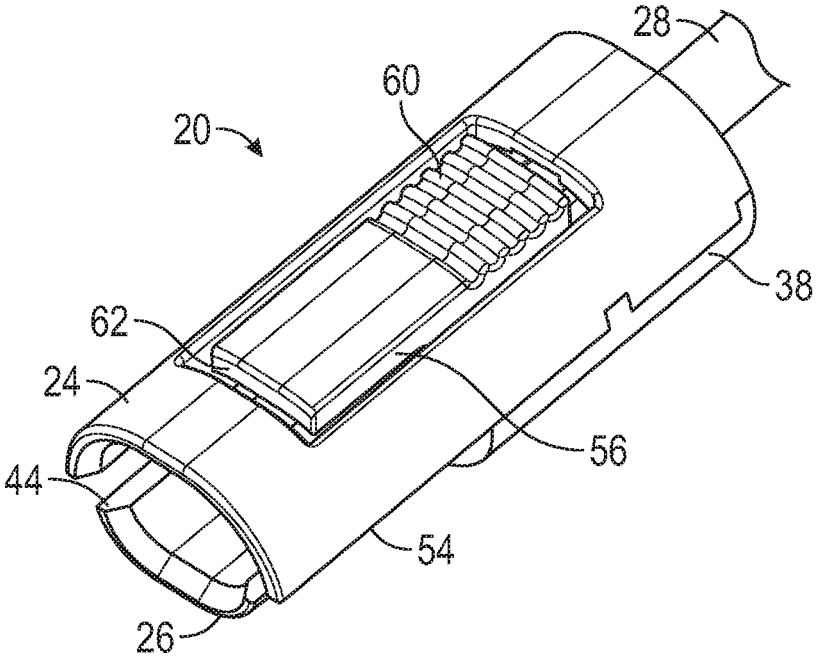
FIG. 3 is a schematic perspective view of the first one of the identical mating connectors.
Figure 4:
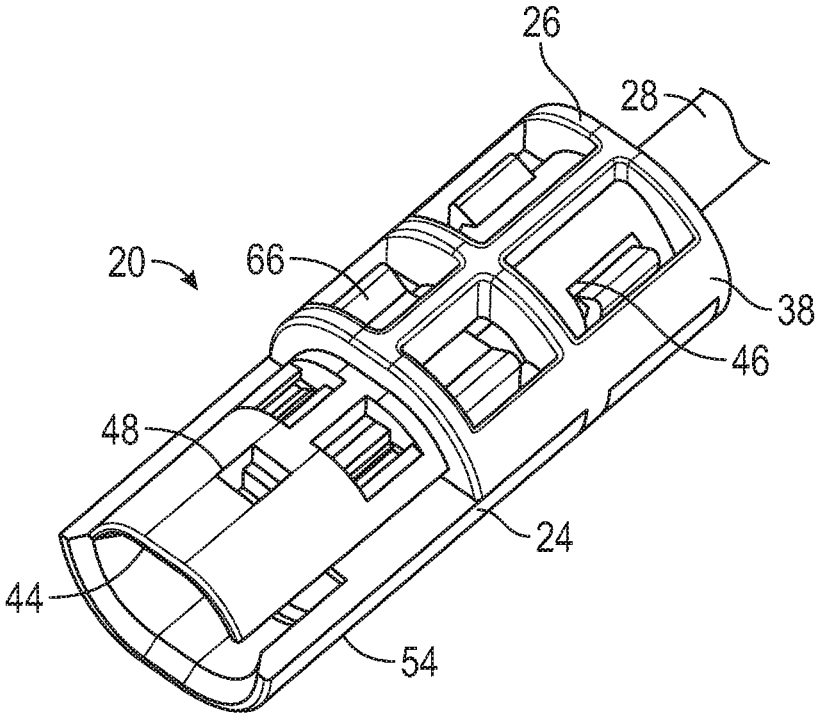
FIG. 4 is a schematic perspective view of the first mating connector of FIG. 3, but flipped over 180 degrees.
Figure 5:
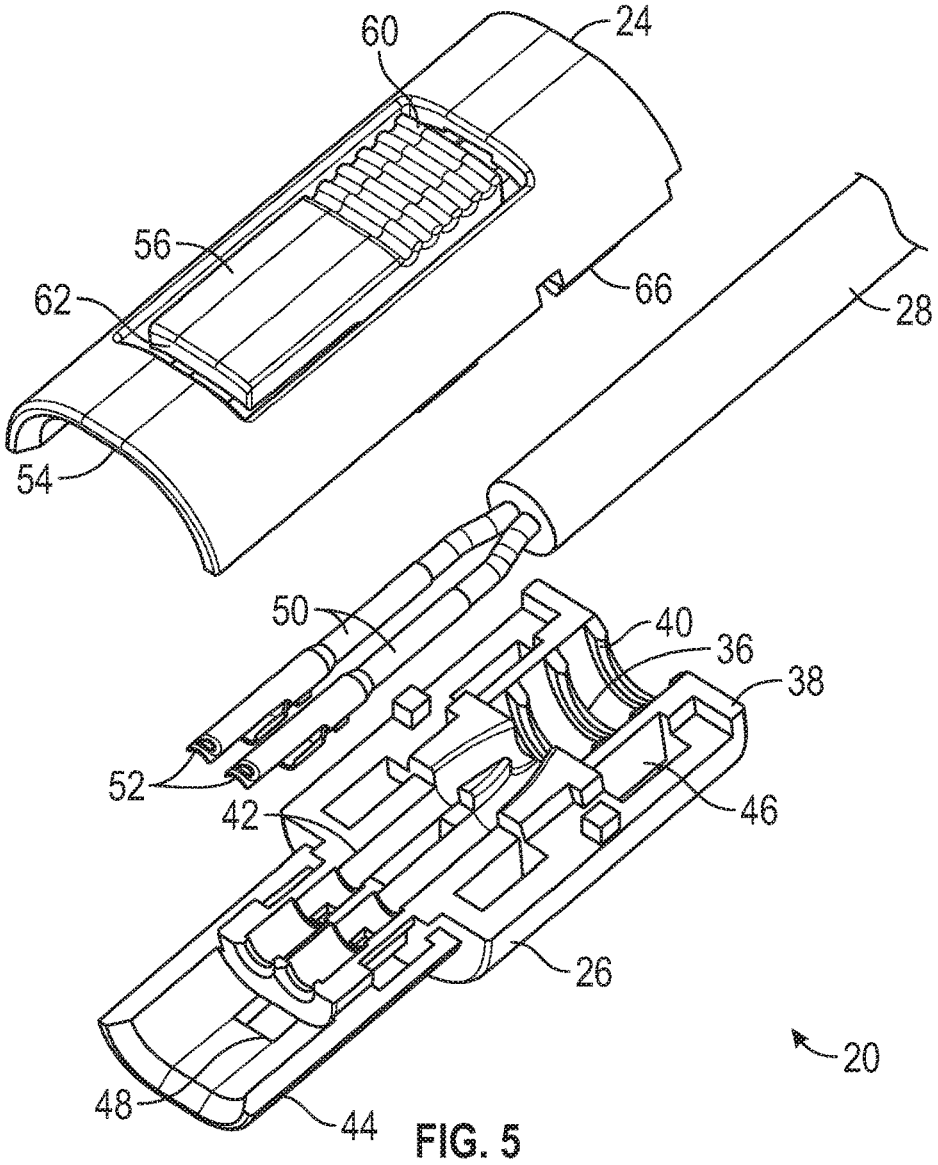
FIG. 5 is a partially exploded, schematic perspective view of the first mating connector of FIG. 3.
Figure 6:
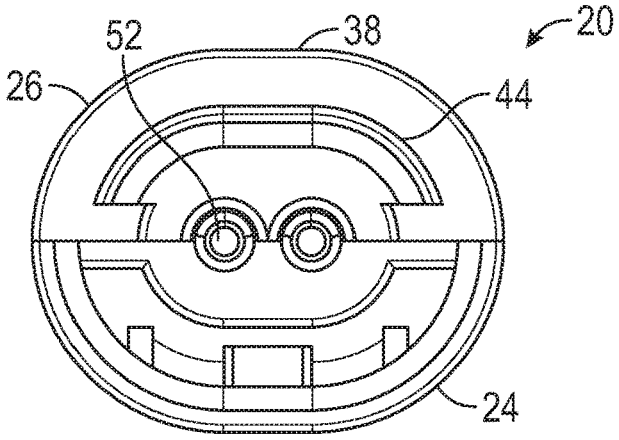
FIG. 6 is a schematic end view of the first mating connector of FIG. 3.
Figure 7:
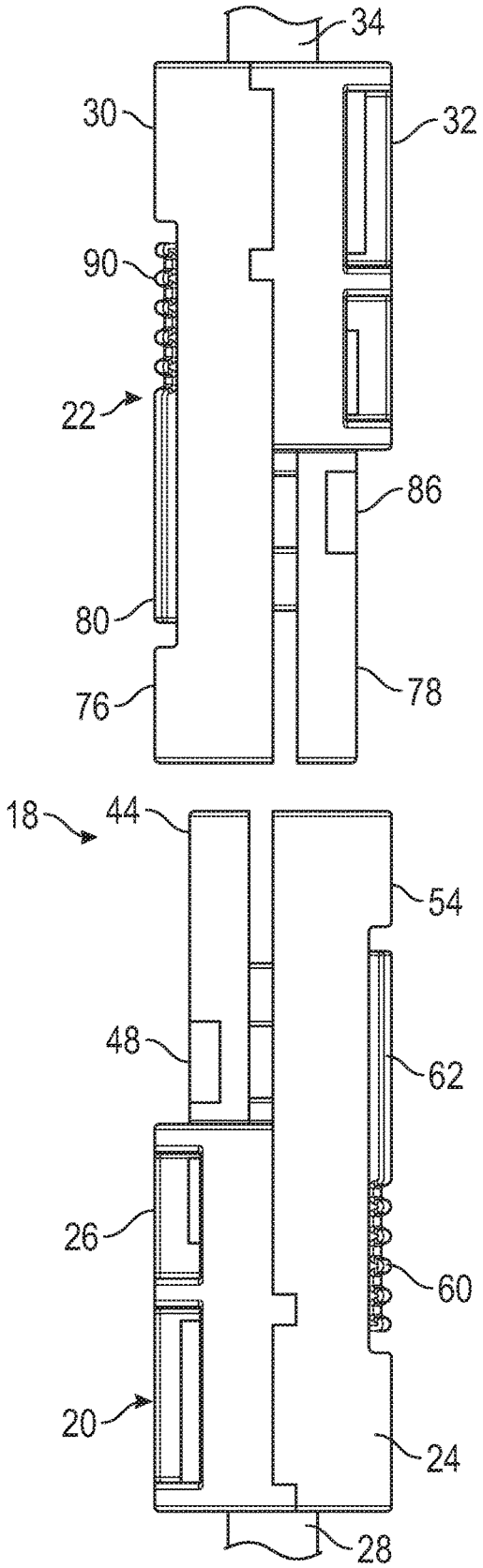
FIG. 7 is a schematic side view of the first and second connectors of FIG. 1, just prior to mating.
Figure 8:
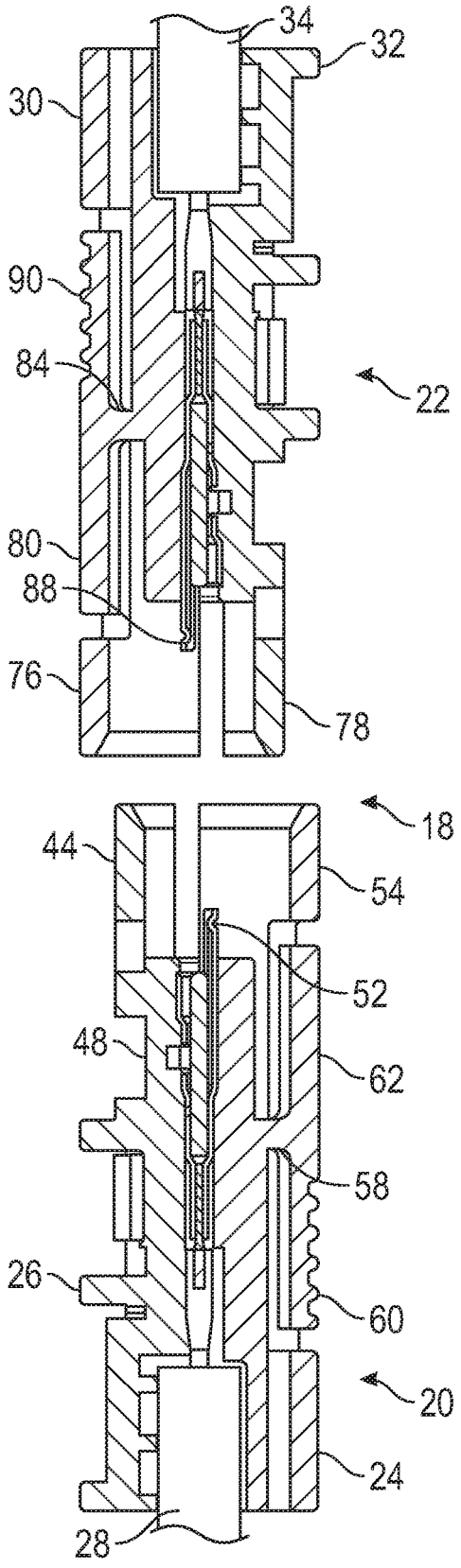
FIG. 8 is a schematic, partial cross section view of the first and second mating connectors of FIG. 7.
Figure 9:
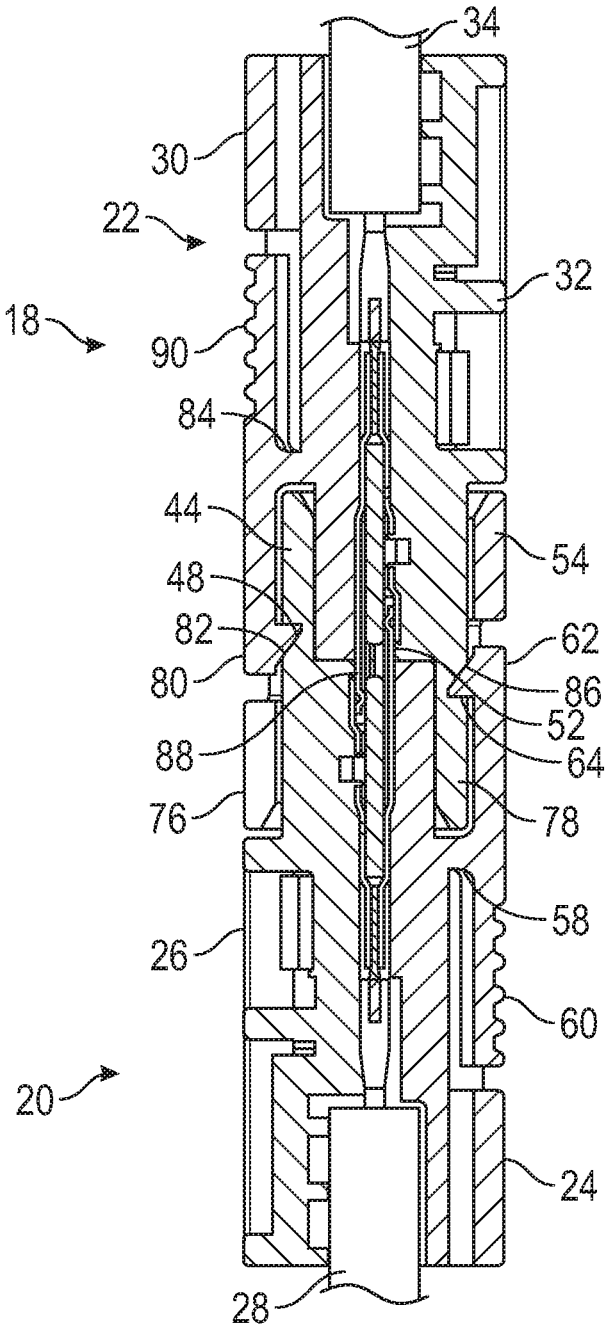
FIG. 9 is a schematic side view of the first and second connectors of FIG. 2, mated together.

As the two connectors 20, 22 are further telescopically slid toward each other, the first connector latch lock 64 snaps into a second connector latch slot 86 of the second lower housing 32 and the second connector latch lock 82 snaps into the first connector latch slot 48 of the first lower housing 26, thus securing (mating) the first connector 20 to the second connector 22 (see in particular FIGS. 2 and 9).

At the same time, as these connectors 20, 22 are telescopically slid together, one of the first terminal contact beams 52 of the first connector wire 28 slide into contact with (mate with) a respective second terminal contact beam 88 of the second connector wire 34 and a second of the first terminal contact beams 52 slides into contact with a second one of the second terminal contact beams 88, thus making the desired electrical connection between the wires 28, 34 (see in particular FIG. 9).

If one wishes to later disconnect the mated connectors 20, 22, then one merely presses on the first rear cantilevered latch release arm 60 and a second rear cantilevered latch release arm 90, causing both to pivot about their respective first 58 and second 84 radial arms, thus releasing the first 64 and second 82 connector latch locks from their respective first 48 and second 86 connector latch slots. While continuing to press on the first 60 and second 90 rear cantilevered latch release arms, one then telescopically pulls the first 20 and second 22 connectors apart.

While certain embodiments of the present invention have been described in detail, those familiar with the art to which this invention relates will recognize various alternative designs and embodiments for practicing the invention as defined by the following claims.

The invention claimed is:

1. An electrical connector, which is mountable to an identical second electrical connector, comprising:

a lower housing including a wire retention channel configured to receive a connector wire therein, terminal retention channels extending from the wire retention channel and configured to receive terminals extending from the connector wire therein, and a latch connector configured to mate with a second latch of the identical second electrical connector to retain the electrical connector to the identical second electrical connector; and an upper housing including securement members that lock to the lower housing to retain the connector wire and the terminals therein and a latch configured to mate with a second latch connector of the identical second electrical connector to retain the electrical connector to the identical second electrical connector, wherein:

the latch includes a latch arm that is cantilevered from the upper housing and has a free end that is rearwardly spaced from a front end of the upper housing; and the latch of the upper housing includes a barb adjacent to the free end of the latch arm and configured to be located such that, when the electrical connector is assembled to the second electrical connector, the barb is closer to the rear of the electrical connector than an identical barb on the second electrical connector is to the rear of the electrical connector.

2. The electrical connector of claim 1 wherein the latch connector of the lower housing is a slot in the housing.

3. The electrical connector of claim 2 wherein the latch arm is connected to a radial arm at an opposed end of the latch arm from the barb, the radial arm extending radially outward from the upper housing; and the upper housing includes a release arm cantilevered from the radial arm in a direction opposite from the latch arm, wherein the release arm is configured such that pivoting the release arm radially inward causes the latch arm to pivot the barb out of engagement with the slot.

4. The electrical connector of claim 3, wherein the release arm is located on an opposite side of the upper housing from the lower housing.

5. The electrical connector of claim 1 wherein the securement members include assembly barbs extending outward from the upper housing toward the lower housing, and the lower housing includes assembly slots that mate with the assembly barbs to secure the upper housing to the lower housing.

6. The electrical connector of claim 1 wherein the terminals each include a terminal contact beam extending therefrom, wherein when the first connector is mated to the identical second connector, the respective terminal contact beams of the first terminals connect to respective terminal contact beams of the identical second electrical connector.

7. The electrical connector of claim 1 wherein the wire retention channel of the lower housing includes circumferentially extending ribs configured to retain the connector wire therein when the upper housing is secured to the respective lower housing.

8. The electrical connector of claim 1 wherein, the latch is integral with the respective upper housing.

9. The electrical connector of claim 1, wherein the latch arm is cantilevered from the upper housing on an opposite side of the upper housing from the lower housing.

* * * * *